US012085276B2

(12) United States Patent
Xiao et al.

(10) Patent No.: US 12,085,276 B2
(45) Date of Patent: Sep. 10, 2024

(54) DRY LOW $NO_X$ STAGED COMBUSTION SYSTEM

(71) Applicant: XI'AN THERMAL POWER RESEARCH INSTITUTE CO. LTD, Shaanxi (CN)

(72) Inventors: Junfeng Xiao, Shaanxi (CN); Xiaofeng Li, Shaanxi (CN); Song Gao, Shaanxi (CN); Feng Wang, Shaanxi (CN); Wei Wang, Shaanxi (CN); Lin Xia, Shaanxi (CN); Mengqi Hu, Shaanxi (CN)

(73) Assignee: XI'AN THERMAL POWER RESEARCH INSTITUTE CO. LTD, Xi'an (CN)

( * ) Notice: Subject to any disclaimer, the term of this patent is extended or adjusted under 35 U.S.C. 154(b) by 371 days.

(21) Appl. No.: 17/740,484

(22) Filed: May 10, 2022

(65) Prior Publication Data

US 2022/0268439 A1 Aug. 25, 2022

Related U.S. Application Data

(63) Continuation of application No. PCT/CN2020/104845, filed on Jul. 27, 2020.

(30) Foreign Application Priority Data

Apr. 7, 2020 (CN) ..... 202010265919.9

(51) Int. Cl.
*F23C 6/00* (2006.01)
*F23C 6/04* (2006.01)
(Continued)

(52) U.S. Cl.
CPC ..... *F23C 6/047* (2013.01); *F23C 9/006* (2013.01); *F23D 14/78* (2013.01); *F23D 14/84* (2013.01);
(Continued)

(58) Field of Classification Search
None
See application file for complete search history.

(56) References Cited

U.S. PATENT DOCUMENTS

2008/0276622 A1* 11/2008 Johnson ..... F23R 3/286 60/800
2011/0005189 A1* 1/2011 Uhm ..... F23N 5/242 60/39.281
(Continued)

OTHER PUBLICATIONS

WIPO, International Search Report for International Application No. PCT/CN2020/104845, Jan. 4, 2021.

*Primary Examiner* — Edwin Kang
(74) *Attorney, Agent, or Firm* — Hodgson Russ LLP

(57) ABSTRACT

A dry low $NO_X$ staged combustion system includes a fuel nozzle and a combustion compartment. The fuel nozzle includes a purge gas tube, a diffusion combustion fuel tube, an isolation gas tube, a premixed combustion fuel tube, a premixed combustion air tube. The purge gas tube is configured to feed a purge gas. The diffusion combustion fuel tube is fitted over the purge gas tube, and having an end provided with a diffusion combustion fuel swirler. The isolation gas tube is fitted over the diffusion combustion fuel tube. The premixed combustion fuel tube is fitted over the isolation gas tube. The premixed combustion air tube is fitted over the premixed combustion fuel tube. The combustion compartment is located downstream of the fuel nozzle.

9 Claims, 1 Drawing Sheet

(51) Int. Cl.

| | |
|---|---|
| ***F23C 9/00*** | (2006.01) |
| ***F23D 14/78*** | (2006.01) |
| ***F23D 14/84*** | (2006.01) |
| ***F23L 7/00*** | (2006.01) |
| ***F23R 3/18*** | (2006.01) |
| ***F23R 3/28*** | (2006.01) |

(52) U.S. Cl.
CPC ..... *F23L 7/007* (2013.01); *F23R 3/18* (2013.01); *F23R 3/286* (2013.01); *F23D 2900/14021* (2013.01)

(56) References Cited

U.S. PATENT DOCUMENTS

| | | | | |
|---|---|---|---|---|
| 2012/0125004 | A1* | 5/2012 | Parsania ..... | F23R 3/14 60/737 |
| 2014/0150445 | A1* | 6/2014 | Huntington ..... | F02C 3/34 60/776 |
| 2017/0241644 | A1* | 8/2017 | Cihlar ..... | F23R 3/14 |

* cited by examiner

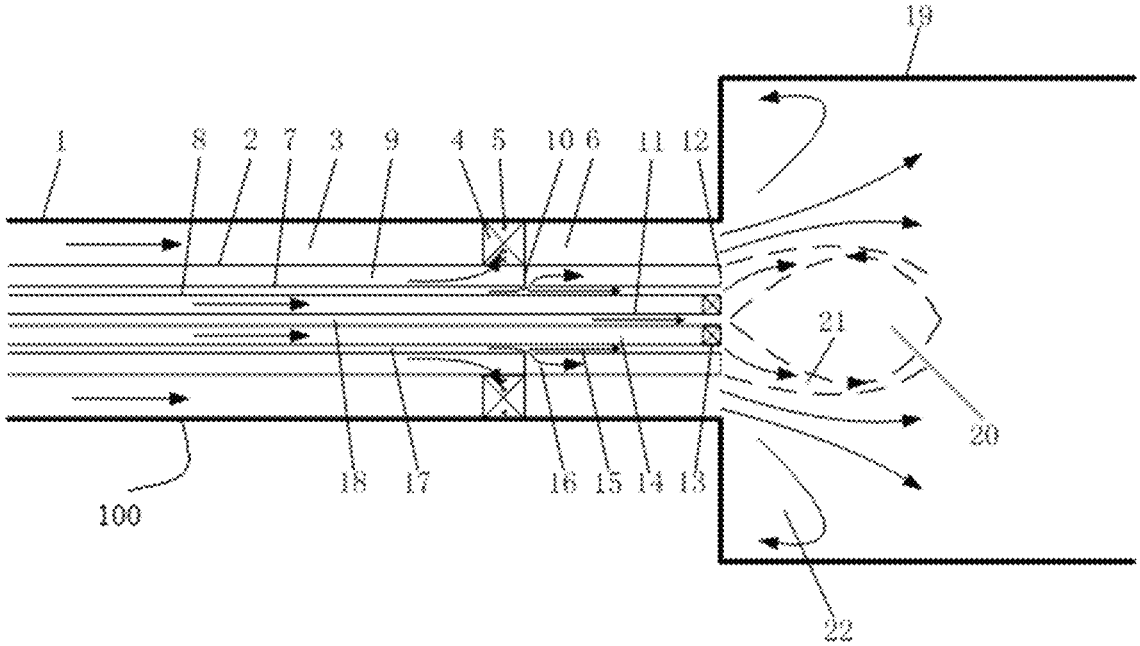
19
1
8
2
7
3
9
4
5
10
6
11
12
21
20
100
18
17
16
15
14
13
22

DRY LOW $NO_X$ STAGED COMBUSTION SYSTEM

CROSS-REFERENCE TO RELATED APPLICATIONS

This application is a continuation of International Application No. PCT/CN2020/104845, filed Jul. 27, 2020, which claims priority to and benefits of Chinese Patent Application No. 202010265919.9, filed on Apr. 7, 2020, the entire contents of which are incorporated herein by reference.

FIELD

The present disclosure relates to a dry low $NO_X$ staged combustion system, and more particularly to a dry low $NO_X$ staged combustion system by isolating $N_2$ from diffusion combustion flame surface.

BACKGROUND

Diffusion combustion and premixed combustion are two common combustion ways for gaseous fuels in gas turbines. The diffusion combustion refers to a combustion process controlled by mixed diffusion factors. Fuel and air are introduced into a combustion compartment respectively, and are mixed and burned at the same time. The diffusion combustion has the characteristics of high combustion flame surface temperature, good flame stability, but high $NO_X$ emission. The premixed combustion refers to a combustion process where fuel and air are fully mixed into a combustible mixture in a nozzle premixer, and then ignited and burned in a combustion compartment. In the premixed combustion process, a mixing ratio may be controlled, such that the premixed combustion has a combustion temperature lower than a theoretical combustion temperature to reduce thermal $NO_X$ generation. However, the premixed combustion has a limited fuel-air ratio for stable combustion, and is prone to result in combustion instability such as flame blowout, tempering and oscillation combustion.

A combustion method of early gas turbines was mainly the diffusion combustion. Due to increasingly stringent regulations for pollutant emission, a way of injecting water or steam into a high-temperature diffusion combustion area, i.e., a wet low-$NO_X$ combustion technology, is adopted, which reduces the combustion temperature and thermal $NO_X$ generation. Though the way of injecting water or steam may reduce a $NO_X$ emission, it will have a harmful effect on properties of a gas turbine, such as circulation performance, component life and maintenance cycle, and it will increase emissions of CO, unburned hydrocarbons and other pollutants. Therefore, a dry low-$NO_X$ staged combustion technology is developed, which adopts a lean premixed staged combustion way to realize a staged combustion control on the fuel. A main fuel accounting for a large proportion is subjected to premixed combustion, and a pilot fuel accounting for a small proportion is subjected to diffusion combustion. By adjusting the fuel-air ratio, the combustion is carried out in a lean fuel state that deviates from the theoretical air amount, thereby controlling the combustion temperature and reducing the $NO_X$ emission. The lean premixed combustion way may reduce the $NO_X$ emission and has been applied in engineering on heavy-duty gas turbines. However, the fuel-air ratio of the lean premixed combustion way is close to a lean burnout limit, and a proportion of the fuel involved in the diffusion combustion is small, such that the combustion in the combustion compartment of the gas turbine is instable, and in severe cases, a cavity structure of the combustion compartment will vibrate laterally and longitudinally, resulting in damage to the combustion compartment, the turbine and other heat channel components, thereby affecting safe and stable operation of the gas turbine.

SUMMARY

Embodiments of the present disclosure provide a dry low $NO_X$ staged combustion system by isolating $N_2$ from diffusion combustion flame surface. The dry low $NO_X$ staged combustion system includes a fuel nozzle and a combustion compartment. The fuel nozzle includes a purge gas tube, a diffusion combustion fuel tube, an isolation gas tube, a premixed combustion fuel tube, and a premixed combustion air tube. The purge gas tube is configured to feed a purge gas. The diffusion combustion fuel tube is fitted over the purge gas tube, and having an end provided with a diffusion combustion fuel swirler. The isolation gas tube is fitted over the diffusion combustion fuel tube. The premixed combustion fuel tube is fitted over the isolation gas tube. The premixed combustion air tube is fitted over the premixed combustion fuel tube, and provided with a premixed passage swirler to divide an interior of the premixed combustion air tube into a premixed combustion air passage upstream of the premixed passage swirler and a premixed chamber downstream of the premixed passage swirler. The fuel nozzle end is located downstream of the purge gas tube, the diffusion combustion fuel tube, the isolation gas tube, the premixed combustion air tube, and the premixed combustion feed tube. The combustion compartment is located downstream of the fuel nozzle. The premixed combustion fuel tube is provided with a cut-off plate on a same section as the premixed passage swirler to divide an interior of the premixed combustion fuel tube into a premixed combustion fuel passage upstream of the cut-off plate and a secondary passage for an isolation gas downstream of the cut-off plate. The premixed combustion fuel passage is communicated with the premixed chamber through the premixed passage swirler. The isolation gas tube defines an isolation gas passage upstream of the cut-off plate and a main passage for the isolation gas downstream of the cut-off plate, and the isolation gas passage is communicated with the secondary passage via an aperture formed in the isolation gas tube downstream of the cut-off plate. An end of the secondary passage coincides with an end of the fuel nozzle. The combustion compartment is communicated with the purge gas tube, the diffusion combustion fuel tube, the premixed chamber, the main passage and the secondary passage, respectively.

In some embodiments, the premixed combustion air passage is an annular cavity formed by an outer wall and an inner wall of the premixed combustion air tube which are located upstream of the premixed passage swirler, and configured to feed air for premixed combustion. The outer wall and the inner wall of the premixed combustion air tube each have a cylindrical structure and are coaxially arranged with respect to each other.

In some embodiments, the premixed combustion fuel passage is an annular cavity formed by an inner wall of the premixed combustion air tube and an inner wall of the premixed combustion fuel tube which are located upstream of the cut-off plate, and configured to feed fuel for premixed combustion. The inner wall of the premixed combustion fuel tube and the inner wall of the premixed combustion air tube each have a cylindrical structure and are coaxially arranged with respect to each other.

In some embodiments, the premixed passage swirler is composed of a group of hollow swirling blades each having a concave surface and a convex surface. Premixed fuel injection holes are formed in the concave surface and the convex surface of each of the hollow swirling blades. The hollow swirling blades are evenly arranged on an inner wall of the premixed combustion air tube in a circumferential direction thereof to change a speed and a direction of air from the premixed combustion air passage and rotate the air.

In some embodiments, the combustion compartment includes a high temperature gas recirculation zone located at a center of the combustion compartment downstream of the fuel nozzle, and filled with a high temperature gas after fuel combustion. The high temperature gas is configured to ignite fresh fuel injected into the combustion compartment from the fuel nozzle.

In some embodiments, the combustion compartment further includes a trapped vortex recirculation zone and a diffusion flame surface isolation zone. The trapped vortex recirculation zone is located around the end of the fuel nozzle and near an expansion section of the combustion compartment, and configured to burn a part of fuel for premixed combustion. The diffusion flame surface isolation zone is located at a peripheral area of the high temperature gas recirculation zone and filled with the isolation gas for insolating $N_2$ in the air from a diffusion combustion flame surface.

In some embodiments, the premixed chamber is an annular cavity formed by an outer wall and an inner wall of the premixed combustion air tube which are located downstream of the premixed passage swirler, and configured to mix air and fuel for premixed combustion in the combustion compartment. The outer wall and the inner wall of the premixed combustion air tube each have a cylindrical structure and are coaxially arranged with respect to each other.

In some embodiments, the isolation gas passage is an annular cavity formed by an inner wall of the premixed combustion fuel tube and an inner wall of the isolation gas tube, and configured to feed the isolation gas. The inner wall of the premixed combustion fuel tube and the inner wall of the isolation gas tube each have a cylindrical structure and are coaxially arranged with respect to each other.

In some embodiments, a diffusion combustion fuel passage defined in the diffusion combustion fuel tube is an annular cavity formed by an inner wall of the isolation gas tube and an inner wall of the diffusion combustion fuel tube, and configured to feed fuel for diffusion combustion; and the inner wall of the isolation gas tube and the inner wall of the diffusion combustion fuel tube each have a cylindrical structure and are coaxially arranged with respect to each other.

In some embodiments, the diffusion combustion fuel swirler is composed of a group of swirling blades, and the swirling blades are evenly arranged on an end of an inner wall of the diffusion combustion fuel tube in a circumferential direction thereof, and configured to change a speed and a direction of fuel for diffusion combustion to inject the fuel into the combustion compartment in a form of a swirling jet.

In some embodiments, the isolation gas is selected from oxygen or a gas mixture of oxygen and carbon dioxide.

In some embodiments, one or more cooling holes are formed in the end of the fuel nozzle.

BRIEF DESCRIPTION OF THE DRAWINGS

FIG. 1 is a schematic diagram showing a dry low-$NO_X$ staged combustion system by isolating $N_2$ from diffusion combustion flame surface in some embodiments of the present disclosure.

REFERENCE NUMBERS

100: fuel nozzle; 1: outer wall of premixed combustion air tube; 2: inner wall of premixed combustion air tube; 3: premixed combustion air tube; 4: premixed passage swirler; 5: premixed fuel injection hole; 6: premixed chamber; 7: inner wall of premixed combustion fuel tube; 8: inner wall of isolation gas tube; 9: premixed combustion fuel tube; 10: cut-off plate: 11: inner wall of diffusion combustion fuel tube; 12: fuel nozzle end; 13: diffusion combustion fuel swirler; 14: diffusion combustion fuel tube; 15: isolation gas main passage; 16: isolation gas secondary passage; 17: isolation gas tube; 18: purge gas tube; 19: combustion compartment; 20: high temperature gas recirculation zone; 21: diffusion flame surface isolation zone; 22: trapped vortex recirculation zone.

DETAILED DESCRIPTION

For a better understanding of the present disclosure, and making technical solution of the present disclosure more clear, the present disclosure will now be described by way of embodiments with reference to the drawing. It should be clarified that the embodiments described are only a part of embodiments of the present disclosure, and are not all of the embodiments thereof, which are not intended to limit the scope of the present disclosure. In addition, well-known structures and technologies are omitted in order to avoid obscuring the concepts of the present disclosure. All other embodiments obtained by those skilled in the art based on the embodiments of the present disclosure without creative efforts shall fall within the protection scope of the present disclosure.

The FIGURES show schematic drawings of some structures according to some embodiments of the present disclosure, which are not intended to be drawn to scale with certain details enlarged or omitted for clarity. The illustrated shapes of various regions and layers in the figures and their relative sizes and positional relationships are only exemplary. In practice, there may be deviations due to manufacturing tolerances or technical limitations, and those skilled in the art may additionally design regions/layers with different shapes, sizes, and relative positions according to actual needs.

In the context of the present disclosure, when a layer/element is referred to as being "above" another layer/element, it can be directly on the other layer/element or intervening layers/elements may be present there between. In addition, if a layer/element is "above" another layer/element in one orientation, then when the orientation is reversed, the layer/element may be "below" the other layer/element.

It should be noted that the terms "first", "second" and the like in specification and in claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. Furthermore, the terms "comprising" and "including" and any variations thereof, are intended to cover a non-exclusive inclusion. For example, a process, method, system, product or device including a series of steps or units is not necessarily limited to those steps or units expressly listed, but may include steps or units not expressly listed or for such process, method, product or device.

In order to improve operational safety of gas turbines using a lean premixed combustion, and to solve a problem that the lean premixed combustion is prone to combustion instability, the present disclosure provides a dry low-$NO_X$ staged combustion system by isolating $N_2$ from a diffusion combustion flame surface, which combines a diffusion combustion and a premixed combustion, and may reduce a $NO_X$ emission and improve combustion stability by increasing a proportion of fuel involved in diffusion combustion in a combustion compartment and isolating $N_2$ from a diffusion combustion flame surface. In the present disclosure, an isolation gas ($O_2$ or a mixture of $O_2$ and $CO_2$) is used to isolate $N_2$ molecules in air from the high temperature diffusion combustion flame surface, thereby reducing reactant concentrations in a thermal $NO_X$ generation chemical reaction and reducing $NO_X$ generation in the combustion compartment. The present disclosure adopts away of isolating the diffusion combustion flame surface to reduce the $NO_X$ emission, and combines the diffusion combustion with good combustion stability to increase the proportion of the fuel involved in diffusion combustion in the staged combustion and enhance the combustion stability.

The present disclosure will be described in detail below with reference to drawings and embodiments.

As shown in FIG. 1, a dry low-$NO_X$ staged combustion system by insolating $N_2$ from diffusion combustion flame surface according to an embodiment of the present disclosure includes a fuel nozzle 100 and a combustion compartment 19. The fuel nozzle 100 includes a purge gas tube 18, a diffusion combustion fuel tube 14, an isolation gas tube 17, a premixed combustion fuel tube 9, and a premixed combustion air tube 3.

The purge gas tube 18 is configured to feed a purge gas. The diffusion combustion fuel tube 14 is fitted over the purge gas tube 18, and has an end provided with a diffusion combustion fuel swirler 4. The isolation gas tube 17 is fitted over the diffusion combustion fuel tube 14. The premixed combustion fuel tube 9 is fitted over the isolation gas tube 17.

The premixed combustion air tube 3 is fitted over the premixed combustion fuel tube 9, and provided with a premixed passage swirler 4 to divide an interior of the premixed combustion air tube 3 into a premixed combustion air passage upstream of the premixed passage swirler 4 and a premixed chamber 6 downstream of the premixed passage swirler 4. The premixed combustion fuel tube 9 is provided with a cut-off plate 10 on a same section as the premixed passage swirler 4 to divide an interior of the premixed combustion fuel tube 9 into a premixed combustion fuel passage upstream of the cut-off plate 10 and an isolation gas secondary passage 16 downstream of the cut-off plate 10. The premixed combustion fuel passage is communicated with the premixed chamber 6 through the premixed passage swirler 4.

The isolation gas tube 17 defines an isolation gas passage upstream of the cut-off plate 10 and a main passage 15 for the isolation gas downstream of the cut-off plate 10, and the isolation gas passage is communicated with the secondary passage 16 via an aperture formed in the isolation gas tube 17 downstream of the cut-off plate 10.

The combustion compartment 19 is located downstream of the fuel nozzle 100 and communicated with the purge gas tube 18, the diffusion combustion fuel tube 14, the premixed chamber 6, the isolation gas main passage 15, and the isolation gas secondary passage 16, respectively.

The purge gas tube 18, the diffusion combustion fuel tube 14, the isolation gas tube 17, the premixed combustion air tube 3, and the premixed combustion fuel tube 9 are sequentially arranged from inside to outside.

The premixed combustion air passage is an annular cavity formed by an outer wall 1 and an inner wall 2 of the premixed combustion air tube 3 upstream of the premixed passage swirler 4, and configured to feed air for premixed combustion. The outer wall 1 and the inner wall 2 of the premixed combustion air tube 3 each have a thin-wall cylindrical structure and are coaxially arranged with respect to each other.

The premixed combustion fuel passage is an annular cavity formed by the inner wall 2 of the premixed combustion air tube 3 and an inner wall 7 of the premixed combustion fuel tube 9 which are located upstream of the cut-off plate 10, and configured to feed fuel for premixed combustion. The inner wall 7 of the premixed combustion fuel tube 9 and the inner wall 2 of the premixed combustion air tube 3 each have a thin-wall cylindrical structure and are coaxially arranged with respect to each other.

The premixed passage swirler 4 is composed of a group of hollow swirling blades each having a concave surface and a convex surface. Premixed fuel injection holes are formed in the concave surface and the convex surface of each of the hollow swirling blades. All of the hollow swirling blades are evenly arranged on the inner wall 2 of the premixed combustion air tube 3 in a circumferential direction thereof to change a speed and a direction of air from the premixed combustion air passage and rotate the air to generate a high temperature gas recirculation zone 20 in the combustion compartment 19.

The combustion compartment 19 includes a high temperature gas recirculation zone 20. The high temperature gas recirculation zone 20 is located at a center of the combustion compartment 19 downstream of the fuel nozzle end 12, and is filled with a high temperature gas after fuel combustion. The high temperature gas is configured to ignite fresh fuel injected into the combustion compartment 19 from the fuel nozzle 100.

The combustion compartment 19 further includes a trapped vortex recirculation zone 22 and a diffusion flame surface isolation zone 21. The trapped vortex recirculation zone 22 is located around the fuel nozzle end 12 and near an expansion section of the combustion compartment 19, and configured to burn a part of fuel for premixed combustion. The diffusion flame surface isolation zone 21 is located at a peripheral area of the high temperature gas recirculation zone 20 and filled with the isolation gas. The isolation gas is configured to provide an oxidant for diffusion fuel combustion and isolate $N_2$ in air for premixed combustion from a diffusion combustion flame surface to reduce $NO_X$ generated in the combustion compartment 19.

The premixed chamber 6 is an annular cavity formed by the outer wall 1 and the inner wall 2 of the premixed combustion air tube 3 which are located downstream of the premixed passage swirler 4. Air and fuel for premixed combustion are mixed in the premixed chamber 6 to form a combustible mixture.

The isolation gas passage is an annular cavity formed by the inner wall 7 of the premixed combustion fuel tube 9 and an inner wall 8 of the isolation gas tube 17, and configured to feed the isolation gas. The inner wall 7 of the premixed combustion fuel tube 9 and the inner wall 8 of the isolation gas tube 17 each have a thin-wall cylindrical structure and are coaxially arranged with respect to each other.

A diffusion combustion fuel passage defined in the diffusion combustion fuel tube 14 is an annular cavity formed by the inner wall 8 of the isolation gas tube 17 and an inner wall 11 of the diffusion combustion fuel tube 14, and configured to feed fuel for diffusion combustion. The inner wall 8 of the isolation gas tube 17 and the inner wall 11 of the diffusion combustion fuel tube 14 each have a thin-wall cylindrical structure and are coaxially arranged with respect to each other.

The diffusion combustion fuel swirler 13 is composed of a group of swirling blades. The swirling blades are evenly arranged on an end of the inner wall 11 of the diffusion combustion fuel tube 14 in a circumferential direction thereof, and configured to change a speed and a direction of fuel for diffusion combustion to inject the fuel into the combustion compartment 19 in a form of a swirling jet.

In some embodiments, the isolation gas is selected from oxygen or a gas mixture of oxygen and carbon dioxide.

In some embodiments, one or more cooling holes are formed in the fuel nozzle end 12.

The dry low-$NO_X$ staged combustion system by isolating $N_2$ from the diffusion combustion flame surface is provided according to embodiments of the present disclosure, which adopts the isolation gas ($O_2$ or a mixture of $O_2$ and $CO_2$) for isolating $N_2$ in air from the high temperature diffusion combustion flame surface, thereby reducing the thermal $NO_X$ generation. In addition, embodiments of the present disclosure combine the diffusion combustion with good combustion stability, which increases the proportion of the fuel involved in the diffusion combustion in the staged combustion to enhance the stability of the lean premixed staged combustion to solve the problems that lean premixed combustion is prone to combustion instability in the existing gas turbines.

As shown in FIG. 1, embodiments of the present disclosure provide a dry low-$NO_X$ staged combustion system by isolating $N_2$ from a diffusion combustion flame surface. The dry low-$NO_X$ staged combustion system includes a premixed combustion air tube 3, a premixed combustion fuel tube 9, a premixed passage swirler 4, a premixed chamber 6, an isolation gas tube 17, a diffusion combustion fuel tube 14, a diffusion combustion fuel swirler 13, a high temperature gas recirculation zone 20, a trapped vortex recirculation zone 22 and a diffusion flame surface isolation zone 21.

As shown in FIG. 1, an outer wall 1 of the premixed combustion air tube 3 has a length of 400 mm, an outer diameter of 60 mm and an inner diameter of 57 mm. An inner wall 2 of the premixed combustion air tube 3 has a length of 400 mm, an outer diameter of 40 mm and an inner diameter of 37 mm. The outer wall 1 and the inner wall 2 of the premixed combustion air tube 3 are coaxially arranged.

The premixed passage swirler 4 is located in an annular cavity formed by the outer wall 1 and the inner wall 2 of the premixed combustion air tube 3. The premixed passage swirler 4 has a group of hollow swirling blades each having a concave surface and a convex surface. Three premixed fuel injection holes with a diameter of 2 mm are formed in the concave surface and the convex surface of each of the hollow swirling blades and located at a distance of 260 mm from a left end of the fuel nozzle. The annular cavity formed by the outer wall 1 and the inner wall 2 of the premixed combustion air tube 3 is divided by the premixed passage swirler 4 into two parts, that is, a premixed combustion air passage located upstream of the premixed passage swirler 4 and the premixed chamber 6 located downstream of the premixed passage swirler 4.

An inner wall 7 of the premixed combustion fuel tube 9 has a length of 400 mm, an outer diameter of 34 mm and an inner diameter of 32 mm. 20 isolation gas injection holes are evenly formed in a circumferential direction of the inner wall 7 of the premixed combustion fuel tube 9, each have a diameter of 2 mm, and are located at a distance of 275 mm from the left end of the fuel nozzle. The inner wall 7 of the premixed combustion fuel tube 9 and the inner wall 2 of the premixed combustion air tube 3 are coaxially arranged.

A cut-off plate 10 is arranged in an annular cavity formed by the inner wall 2 of the premixed combustion air tube 3 and the inner wall 7 of the premixed combustion fuel tube 9, and located at a distance of 270 mm from the left end of the fuel nozzle. The annular cavity formed by the inner wall 2 of the premixed combustion air tube 3 and the inner wall 7 of the premixed combustion fuel tube 9 is divided by the cut-off plate 10 into two parts, that is, a premixed combustion fuel passage located upstream of the cut-off plate 10, and an isolation gas secondary passage 16 located downstream of the cut-off plate 10.

An end of the inner wall 7 of the premixed combustion fuel tube 9 and an end of the inner wall 2 of the premixed combustion air tube 3 are connected with each other by the fuel nozzle end 12. The fuel nozzle end 12 is provided with film cooling holes.

An inner wall 8 of the diffusion combustion isolation gas tube has a length of 400 mm, an outer diameter of 30 mm and an inner diameter of 28 mm. The inner wall 7 of the premixed combustion fuel tube 9 and the inner wall 8 of the diffusion combustion isolation gas tube are coaxially arranged.

An inner wall 11 of the diffusion combustion fuel tube 14 has a length of 400 mm, an outer diameter of 14 mm and an inner diameter of 10 mm. The inner wall 11 of the diffusion combustion fuel tube 14 and the inner wall 8 of the diffusion combustion isolation gas tube are coaxially arranged. The diffusion combustion fuel tube 14 defines an annular cavity formed by the inner wall 8 of the diffusion combustion isolation gas tube and the inner wall 11 of the diffusion combustion fuel tube 14.

A purge gas tube 18 defines a circular passage formed by the inner wall 11 of the diffusion combustion fuel tube 14. The diffusion combustion fuel swirler 13 is located at an end of the diffusion combustion fuel tube 14.

A method of operating the dry low-$NO_X$ staged combustion system by isolating $N_2$ from the diffusion combustion flame surface in embodiments of the present disclosure includes steps as follows.

Air for premixed combustion is introduced into the fuel nozzle through the premixed combustion air tube 3. A flow direction of the air changes from an axial motion to a rotational motion under a guiding action of the premixed passage swirler 4 to form rotating air. Fuel for the premixed combustion is fed into the fuel nozzle through the premixed combustion fuel tube 9, and introduced into the premixed chamber 6 via the fuel injection holes in the swirling blades of the premixed passage swirler 4. In the premixed chamber 6, the fuel for the premixed combustion and the rotating air are mixed to form a combustible mixture, and the combustible mixture is injected into the combustion compartment 19 in a form of a rotating jet.

An isolation gas 02 is introduced into the fuel nozzle through the diffusion combustion isolation gas tube 17. Downstream of the fuel nozzle, a first part of the isolation gas is injected into the secondary passage 16 through the isolation gas injection holes, and is finally introduced into the combustion compartment 19 through the film cooling holes in the fuel nozzle end 12. The first part of the isolation gas may be used to isolate $N_2$ from the high temperature diffusion combustion flame surface, cool the fuel nozzle end 12 and participate in the diffusion combustion. A second part of the isolation gas is introduced into the combustion compartment 19 through the main passage 15, which may be used to isolate $N_2$ from the high temperature diffusion combustion flame surface and provide an oxidant for the diffusion combustion.

The fuel for the diffusion combustion is fed into the fuel nozzle through the diffusion combustion fuel tube 14, and is finally injected into the combustion compartment 19 through the diffusion combustion fuel swirler 13 in a form of a rotating jet. A purge gas is injected into the combustion compartment 19 through the purge gas tube 18 after passing through the fuel nozzle to prevent combustion flashback from ablating the fuel nozzle.

During working of the combustion compartment 19, the combustible mixture for the premixed combustion is injected into the combustion compartment 19 in a form of a rotating jet to form the high temperature gas recirculation zone 20 and the trapped vortex recirculation zone 22 in the combustion compartment 19. The fuel for the diffusion combustion is injected into the combustion compartment 19 through the diffusion combustion fuel swirler 13 in a form of a rotating jet, and is distributed on a periphery of the high temperature gas recirculation zone 20. The isolation gas is introduced into the combustion compartment 19 through the main passage 15 and the fuel nozzle end 12, and is rotated along with the fuel for the diffusion combustion under a gas viscous force, so as to completely wrap the fuel for the diffusion combustion. The fuel for the diffusion combustion is reacted with the isolation gas to form the diffusion combustion flame surface at the periphery of the high temperature gas recirculation zone 20. The excess isolation gas is used to isolate the diffusion combustion flame surface from $N_2$ in the peripheral premixed combustible mixture to reduce thermal $NO_X$ generation. The combustible mixture is ignited by the gas at a rear of the high temperature gas recirculation zone 20, and completely burns in a periphery of the combustion chamber and the trapped vortex recirculation zone 22.

The above embodiments are only to illustrate the technical idea of the present disclosure, but not construed as limiting the scope of the present disclosure. If there are any changes made on the basis of the technical solution related to the technical idea of the present disclosure, all of them should be included in the protection scope of the claims of the present disclosure.

What is claimed is:

1. A dry staged combustion system, comprising:

a fuel nozzle comprising:

a purge gas tube configured to feed a purge gas;

a diffusion combustion fuel tube fitted over the purge gas tube, and having an end provided with a diffusion combustion fuel swirler;

an isolation gas tube fitted over the diffusion combustion fuel tube;

a premixed combustion fuel tube fitted over the isolation gas tube; and a premixed combustion air tube fitted over the premixed combustion fuel tube, and provided with a premixed passage swirler to divide an interior of the premixed combustion air tube into a premixed combustion air passage upstream of the premixed passage swirler and a premixed chamber downstream of the premixed passage swirler; and a combustion compartment located downstream of the fuel nozzle and communicated with the purge gas tube, the diffusion combustion fuel tube, and the premixed chamber, respectively;

wherein the premixed combustion fuel tube is provided with a cut-off plate on a same section as the premixed passage swirler to divide an interior of the premixed combustion fuel tube into a premixed combustion fuel passage upstream of the cut-off plate and a secondary passage for an isolation gas downstream of the cut-off plate, and the premixed combustion fuel passage is communicated with the premixed chamber through the premixed passage swirler;

wherein the isolation gas tube defines an isolation gas passage upstream of the cut-off plate and a main passage for the isolation gas downstream of the cut-off plate, and the isolation gas passage is communicated with the secondary passage via an aperture formed in the isolation gas tube downstream of the cut-off plate;

wherein an end of the secondary passage coincides with an end of the fuel nozzle; and wherein the combustion compartment is communicated with the main passage and the secondary passage, respectively.

2. The dry staged combustion system according to claim 1, wherein the premixed combustion air passage is an annular cavity formed by an outer wall and an inner wall of the premixed combustion air tube which are located upstream of the premixed passage swirler, and configured to feed air for premixed combustion; and the outer wall and the inner wall of the premixed combustion air tube each have a cylindrical structure and are coaxially arranged with respect to each other.

3. The dry staged combustion system according to claim 1, wherein the premixed combustion fuel passage is an annular cavity formed by an inner wall of the premixed combustion air tube and an inner wall of the premixed combustion fuel tube which are located upstream of the cut-off plate, and configured to feed fuel for premixed combustion; and the inner wall of the premixed combustion fuel tube and the inner wall of the premixed combustion air tube each have a cylindrical structure and are coaxially arranged with respect to each other.

4. The dry staged combustion system according to claim 1, wherein the combustion compartment comprises a high temperature gas recirculation zone located at a center of the combustion compartment downstream of the fuel nozzle, and filled with a high temperature fuel gas after fuel combustion; and the high temperature fuel gas is configured to ignite fresh fuel injected into the combustion compartment from the fuel nozzle.

5. The dry staged combustion system according to claim 4, wherein the combustion compartment further comprises:

a trapped vortex recirculation zone located around the end of the fuel nozzle and near an expansion section of the combustion compartment, and configured to burn a part of fuel for premixed combustion; and a diffusion flame surface isolation zone located at a peripheral area of the high temperature gas recirculation zone and filled with the isolation gas for insolating N2 in air from a diffusion combustion flame surface.

6. The dry staged combustion system according to claim 1, wherein the premixed chamber is an annular cavity formed by an outer wall and an inner wall of the premixed combustion air tube which are located downstream of the premixed passage swirler, and configured to mix air and fuel for premixed combustion; and the outer wall and the inner wall of the premixed combustion air tube each have a cylindrical structure and are coaxially arranged with respect to each other.

7. The dry staged combustion system according to claim 1, wherein the isolation gas passage is an annular cavity formed by an inner wall of the premixed combustion fuel tube and an inner wall of the isolation gas tube, and configured to feed the isolation gas; and the inner wall of the premixed combustion fuel tube and the inner wall of the isolation gas tube each have a cylindrical structure and are coaxially arranged with respect to each other.

8. The dry staged combustion system according to claim 1, wherein a diffusion combustion fuel passage defined in the diffusion combustion fuel tube is an annular cavity formed by an inner wall of the isolation gas tube and an inner wall of the diffusion combustion fuel tube, and configured to feed fuel for diffusion combustion; and the inner wall of the isolation gas tube and the inner wall of the diffusion combustion fuel tube each have a cylindrical structure and are coaxially arranged with respect to each other.

9. The dry staged combustion system according to claim 1, wherein the isolation gas is selected from oxygen or a gas mixture of oxygen and carbon dioxide.

* * * * *